US007887461B2

(12) United States Patent
Bakhtiyari

(10) Patent No.: US 7,887,461 B2
(45) Date of Patent: Feb. 15, 2011

(54) LIP STRENGTHENING DEVICE

(76) Inventor: Maryam Bakhtiyari, 1117 2nd St., Manhattan Beach, CA (US) 90266

( * ) Notice: Subject to any disclaimer, the term of this patent is extended or adjusted under 35 U.S.C. 154(b) by 0 days.

(21) Appl. No.: 12/500,821

(22) Filed: Jul. 10, 2009

(65) Prior Publication Data

US 2011/0009242 A1 Jan. 13, 2011

(51) Int. Cl.
*A63B 23/03* (2006.01)
*A63B 21/02* (2006.01)

(52) U.S. Cl. ..... 482/11; 482/124; 482/127; 601/38

(58) Field of Classification Search ..... 482/10, 482/11, 49, 121, 122, 127, 140; D21/662, D21/692, 693; 601/38; 600/242, 201, 208, 600/212, 223, 237; 606/204.15; 433/69; 128/859, 860, 861, 862, 863
See application file for complete search history.

(56) References Cited

U.S. PATENT DOCUMENTS 1,025,265 A * 5/1912 Grindle ..... 600/219
1,363,534 A * 12/1920 Rogers ..... 606/204.15
1,389,436 A * 8/1921 Cameron ..... 600/219
1,714,029 A * 5/1929 Kuhn ..... 482/11
1,851,865 A * 3/1932 Ptacek ..... 482/11
2,529,347 A * 11/1950 Ross, Jr. et al. ..... 482/126
2,708,931 A * 5/1955 Freedland ..... 128/861
3,813,096 A * 5/1974 Welch ..... 482/11
3,938,508 A 2/1976 Buckner
4,200,089 A * 4/1980 Inoue ..... 600/242
4,280,696 A * 7/1981 Ramon ..... 482/11
4,483,533 A * 11/1984 Mangiapane ..... 482/122
4,671,260 A 6/1987 Buckner
D338,247 S * 8/1993 Koblick ..... D21/692
D341,401 S * 11/1993 Reichman ..... D21/692
D343,882 S * 2/1994 Bennstrom et al. ..... D21/692
5,674,164 A * 10/1997 Kravitz ..... 482/126
D388,846 S 1/1998 Burghoffer
D397,173 S 8/1998 Edell
5,919,116 A 7/1999 Edell
6,179,747 B1 1/2001 Kelley
6,406,405 B1 6/2002 Chu
6,524,262 B1 2/2003 Akihiro
7,008,354 B2 * 3/2006 Wen ..... 482/127
7,134,986 B2 11/2006 Tiberio
D541,118 S * 4/2007 Clark ..... D8/1
7,238,144 B2 7/2007 Ferrara
7,462,132 B2 * 12/2008 Kuehne ..... 482/11
7,607,917 B2 * 10/2009 Virnicchi et al. ..... 433/29
7,662,066 B2 * 2/2010 Ferrara ..... 482/11
7,708,018 B1 * 5/2010 Hirshberg ..... 128/861
2009/0308403 A1 * 12/2009 Roettger et al. ..... 128/861
2010/0011916 A1 * 1/2010 Christensen, III ..... 81/342

* cited by examiner

*Primary Examiner*—Loan Thanh
*Assistant Examiner*—Daniel F Roland
(74) *Attorney, Agent, or Firm*—Edwin Tarver; Lauson & Tarver

(57) ABSTRACT

A facial muscle strengthening and lip strengthening device comprises a primary hinge attached to two articulating arms and biased to a predetermined position. Lip-engaging members are attached to the articulating arms opposite the primary hinge and are also attached to the articulating arms in a hinged manner. The lip-engaging members comprise saddle-shaped units to be disposed in front, back, and atop the lips of a user. To employ the device, a user places the device between the lips in a vertical, horizontal or slanted orientation and compresses the device, bringing the lip-engaging members proximally together and causing the primary hinge to depend laterally away from the mouth of the user.

4 Claims, 2 Drawing Sheets

LIP STRENGTHENING DEVICE

BACKGROUND

Various devices have been developed to exercise and strengthen the muscles of the face. Others have been developed to give lips a more full appearance. While these devices on the principal of creating resistance between users' lips, none of the devices are capable of allowing the lip-engaging portion of the device to remain in a static position on the lip while the resistance portion of the device is in motion. Therefore it is an object of the present invention to provide a lip exercising device that maintains its position when in use, strengthens facial muscles and can be manufactured simply and economically. These and other objects will become apparent from the appended Summary, Description and Claims.

SUMMARY

The present invention comprises an improved lip exercising device with a primary hinge biased to a predetermined position and connected to two articulating members that articulate relative to each other. When the hinge is in its resting position, the articulating members point substantially away from each other at an obtuse angle. Lip-engaging members are disposed at the end of each articulating member opposite the primary hinge, and the connection between each lip-engaging member and its corresponding articulating member comprises a secondary hinge.

The lip-engaging members comprise a substantially saddle-shaped configuration to maintain contact with a user's lips when the device is contracted and expanded. The saddle shape comprises a forward member and rear member that rest on either side of a user's lips when the device is in use. The larger size of the rear member allows it to anchor between the inside of a user's lip and gums to add stability.

The primary hinge comprises a spring within cylindrically shaped housing. The housing comprises two corresponding shells that come together to house the spring. As the shells of the housing turn relative to each other, tension created in the spring causes resistance when the device is used. The ends of the articulating members attached to the primary hinge comprise angles allowing the articulating members to maintain planar alignment as they move.

A user positions the device so that the back and front members of the lip-engaging members are disposed on the inside, outside and over the lips of the mouth. Tension provided by the biasing of the primary hinge keeps the device in position. When a user compresses the device, the primary hinge depends laterally away from the user's mouth as the lip-engaging devices gradually come together. As the articulating arms articulate relative to the lip-engaging members, the lip-engaging members remain in position relative to a user's lips by virtue of the secondary hinges.

DESCRIPTION

Figure 1:
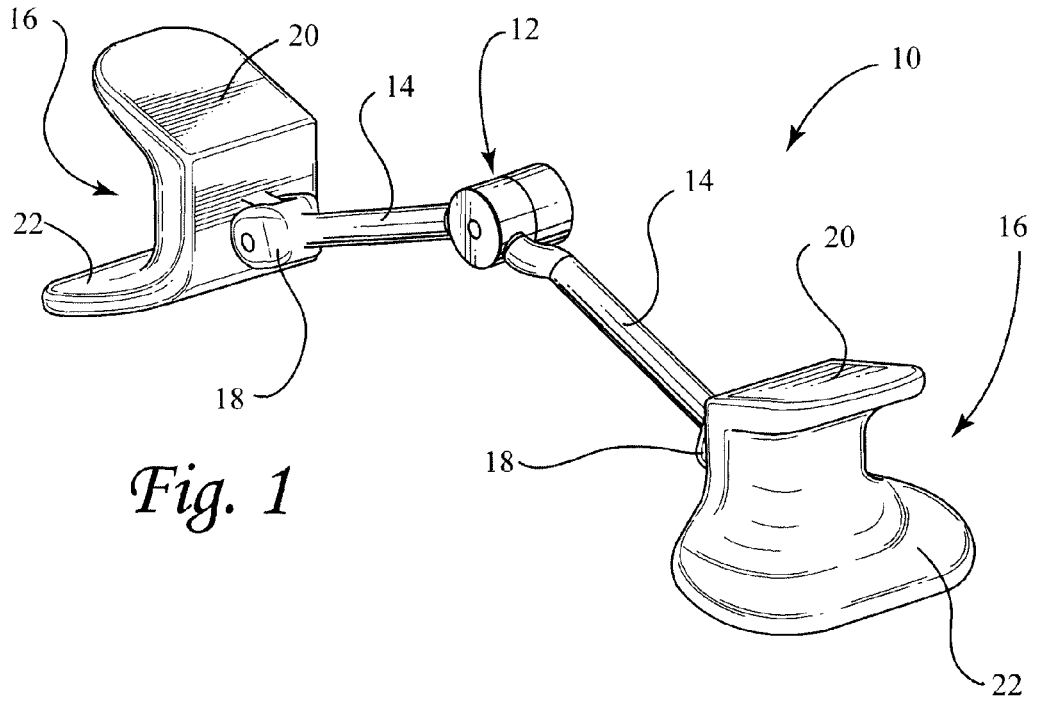
FIG. 1 is a perspective view of the lip exercising device.

Referring to FIG. 1, an improved lip exercising device 10 comprises a primary hinge 12 biased to a predetermined position. The primary hinge 12 is connected to two articulating members 14 that articulate relative to each other using the hinge, which acts as a hub. When the hinge 12 is in a resting position, the articulating arms 14 point substantially away from each other, however are not in 180° opposition and rest at an obtuse angle. The positioning of the bias in the hinge 12 ensures that the articulating members 14 always travel in the same direction when the device 10 is compressed.

Still referring to FIG. 1, a lip-engaging member 16 is disposed at the end of each articulating member 14 opposite the primary hinge 12. The connection between each lip-engaging member 16 and its corresponding articulating member 14 comprises a secondary hinge 18. The secondary hinge allows the articulating members 14 to move relative to the lip-engaging members 16 as the device 10 is used, so that the lip-engaging members remain in position relative to the user's lips.

Still referring to FIG. 1, the lip-engaging members 16 comprise a substantially saddle-shaped configuration to maintain contact with the inside and outside of a user's lips when the device 10 is contracted and then allowed to expand back to a resting position. The saddle shape comprises a forward member 20 and a rear member 22, which rest on either side of a user's lips when the device 10 is in use. The larger size of the rear member 22 allows it to anchor between the inside of a user's lip and the user's teeth and gums to add stability as the device is used.

In one preferred embodiment, the rear member 22 comprises a notch, allowing it to anchor against the upper labial frenum and lower labial frenum when the device is in a vertical position. In a further preferred embodiment, the surface of the saddle-shaped lip-engaging members 16 comprises a cushioning material at the point of contact with a user's lips. In yet another preferred embodiment, the saddle-shaped lip-engaging members comprise a pliable yet resilient structure made from silicon, plastic or resin based materials to preserve the shape of the lip-engaging member yet provide comfort to a user.

Figure 2:
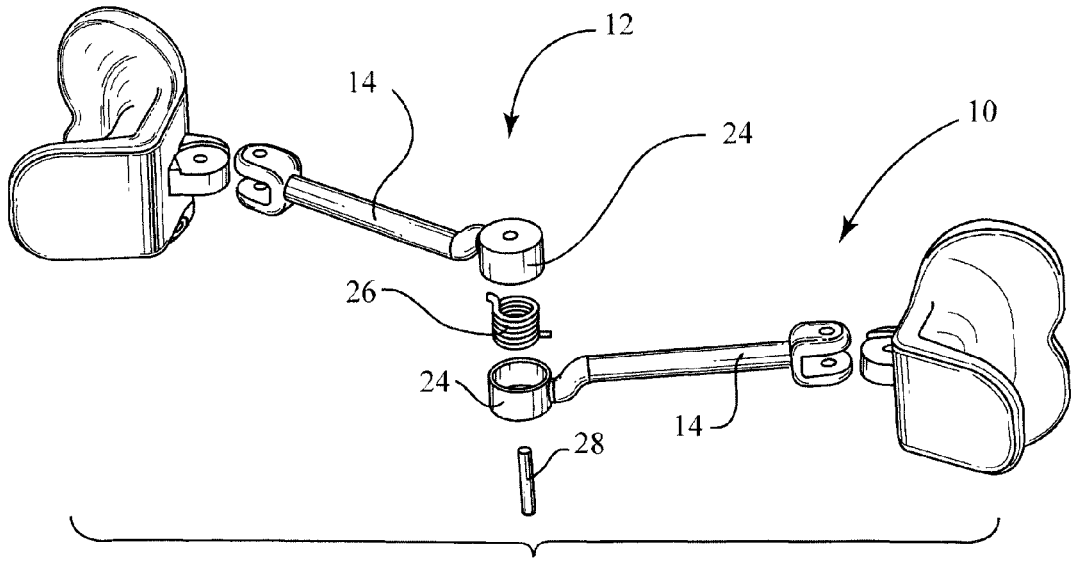
FIG. 2 is a perspective exploded view of the lip exercising device.

Referring to FIG. 2, the primary hinge 12 comprises a cylindrically shaped housing 24 in which a spring 26 is disposed. The housing 24 comprises two corresponding shells that come together to house the spring 26. Since one end of the spring 26 is held against one shell of the housing 24 and the other end of the spring 26 is held against the other shell of the housing 24, the device 10 is biased to a resting position. As the two shells of the housing 24 turn relative to each other, tension created in the spring 26 causes resistance when the device 10 is contracted. A rivet member 28 holds the shells of the housing 24 together and in proper alignment.

Still referring to FIG. 2, the ends of the articulating members 14 attached to the primary hinge 12 comprise angles allowing the articulating members 14 to maintain a planar alignment as the device 10 is operated. By maintaining the articulating members 14 in the same plane as they articulate, stress on the primary hinge 12 is reduced, prolonging the life of the device 10.

In one preferred embodiment, the device is between 3 cm and 4 cm in length in its resting position. The front member of the lip-engaging members is about 0.5 cm wide. The rear member of the lip-engaging members is about 1 cm wide, and both front and rear members are 0.5 cm tall from the base of the lip-engaging members.

The structure of the device having been shown and described, use of the device is now discussed.

Figure 3:
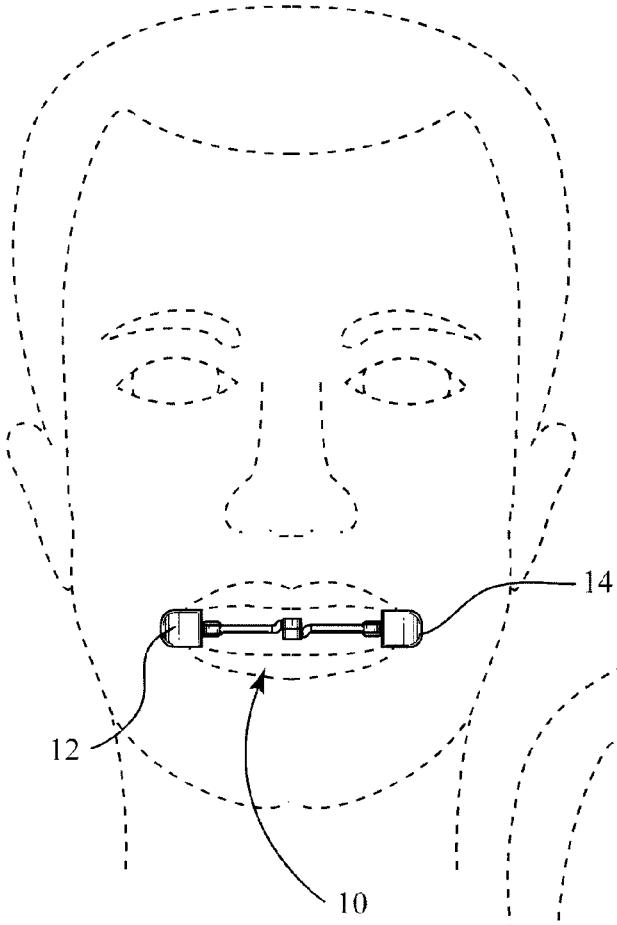
FIG. 3 shows the device used in a vertical orientation.
Figure 4:
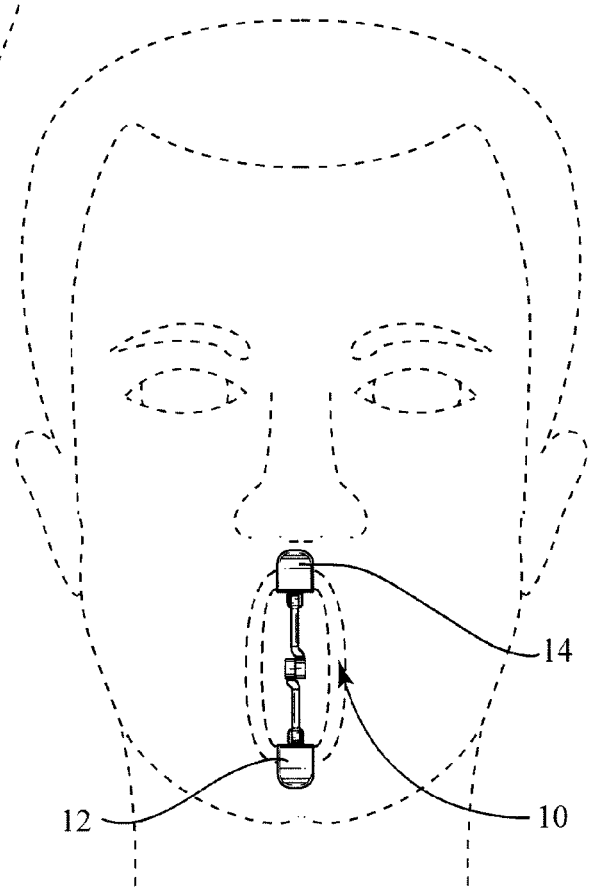
FIG. 4 shows the device used in a horizontal orientation

In order to use the device, a user positions the device in the mouth so that the back and front members of the lip-engaging devices are disposed on the inside and outside of the lips, respectively. In various embodiments, the device may be positioned vertically between the top and bottom lips as shown in FIG. 3, horizontally at the corners of the mouth as shown in FIG. 4, or in a slanted position between the upper and lower lip [not shown]. The tension provided by the biasing of the primary hinge keeps the device in position.

As a user compresses the device, the primary hinge depends laterally away from the user's mouth and the lip-engaging devices gradually come together. As the articulating arms articulate relative to the lip-engaging members, the lip-engaging members remain in position relative to the user's lips.

As exercises are performed in various positions, the muscles of the lips and surrounding facial musculature are exercised. The list of muscles improved by the device include, but are not limited to: levator labii, levator angulioris, depressor angulioris, depressor labui inferioris, compressor naris, orbicularis oculi, cornigator supercilii, frontalis, procerus, orbicularis oris, resorius, mentalis, zygomaticus minor, platysma, buccinator, depressores (triangularis and quadrates), lateral ptergoid, medial pterygoid, digastics, tempora mandibular ligament, sternomastoid, and stylohyoid.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, paragraph 6. In particular, the use of "step of" in the claims herein is not intended to invoke the provisions of 35 U.S.C. §112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A lip exercising device comprising:

a. a primary hinge comprising a housing enclosed spring biased to a predetermined position;

b. two articulating members, each having a first end and a second end, the first end of each articulating member attached to the primary hinge in a position whereby when the hinge rests in the biased position, the articulating members are disposed at an obtuse angle in relation to each other;

c. each articulating member also comprising an angle between said first and said second end, whereby the second ends of the articulating members are disposed at and articulate in parallel within the same plane of movement; and d. a lip-engaging member capable of simultaneously resting on the inside and outside of a user's lips, connected to the second end of each articulating member, wherein the connection between each lip-engaging member and articulating member comprises a secondary hinge allowing the lip-engaging members to articulate relative to the articulating members.

2. The device of claim 1, wherein the housing comprises two adjacent cylinders each cylinder connected to a different articulating member.

3. The device of claim 1, wherein the second cud of each articulating member connects to the primary hinge using an off-set angle, so that the articulating members articulate in the same two-dimensional plane.

4. A lip exercising device comprising:

a. a primary hinge biased to a predetermined position and comprising a housing containing a spring;

b. two articulating members, each having a first end and a second end, the first end of each articulating member attached to the primary hinge in a position so that when the hinge rests in the biased position, the articulating members are disposed at an obtuse angle in relation to each other;

c. a saddle-shaped lip-engaging member connected to the second end of each articulating member, wherein the connection between each lip-engaging member and articulating member comprises a secondary hinge allowing the lip-engaging members to articulate relative to the articulating members; and d. wherein when a user compresses the device by reducing the distance between the saddle-shaped lip-engaging members and the primary hinge depends away from a biased position, the secondary hinges allow the articulating members to articulate relative to the saddle-shaped lip-engaging members so that the saddle-shaped lip-engaging members remain in the same position relative to a user's lips.

* * * * *